United States Patent [19]

Borghetto

[11] Patent Number: 4,458,464

[45] Date of Patent: Jul. 10, 1984

[54] PROCESS AND APPARATUS FOR ERECTING WALLS MADE OF GLASS STRUCTURAL BRICKS AND AT LEAST A JOINT MORTAR, TOGETHER WITH A JOINT LINING AND, IF NECESSARY, REINFORCEMENT

[76] Inventor: Oddo Borghetto, Via Giotto 19, 1-31033 Castelfranco-Veneto (TV), Italy

[21] Appl. No.: 274,150

[22] Filed: Jun. 16, 1981

[30] Foreign Application Priority Data

Jun. 17, 1980 [IT] Italy ..... 41587 A/80

[51] Int. Cl.[3] ..... E04B 2/56

[52] U.S. Cl. ..... 52/477

[58] Field of Search ..... 52/307, 308, 477, 436, 52/438, 562, 712, 713

[56] References Cited

U.S. PATENT DOCUMENTS

| | | | |
|---|---|---|---|
| 2,124,799 | 7/1938 | Specht | 52/308 |
| 2,140,997 | 12/1938 | Hohl | 52/477 |
| 2,141,000 | 12/1938 | Hohl | 52/308 |
| 2,156,623 | 5/1939 | Eastus | 52/308 |
| 2,176,213 | 10/1939 | Duffy . | |
| 2,282,964 | 5/1942 | Hohl | 52/477 |
| 2,308,242 | 1/1943 | Hohl | 52/477 |

FOREIGN PATENT DOCUMENTS 134699 6/1900 Fed. Rep. of Germany .

1394241 2/1965 France .

*Primary Examiner*—James L. Ridgill, Jr.

*Attorney, Agent, or Firm*—Andrus, Sceales, Starke & Sawall

[57] ABSTRACT

The invention relates to a method for erecting walls made of glass structural bricks and a joint-lining in which the said bricks are built up with the joint-mortar, if necessary strengthened with reinforcing elements, with substantially horizontal and vertical joints, brick by brick, from bottom to top of the wall and the joints therein are lined, in connection with which, and for the purpose of reducing the need for skilled masons to such an extent that correct laying of the glass bricks may also be carried out by unskilled and untrained labor, and so that the amount of equipment required at the work-site may be considerably reduced or completely eliminated, provision is made, according to the invention, for the respective outer and inner linings of the horizontal and vertical joints to be applied, whereupon the lining of at least one horizontal joint, possibly after inspection of the reinforcing rods between the said joint-linings, is used as a lost outer shuttering for the joint-mortar and serves thereafter as a retainer for the glass bricks which are placed upon the linings of the horizontal joints and against the linings of the vertical joints, thus forming, together with the joint-linings, mould-cavities for the joint-mortar to be poured into the joints.

10 Claims, 37 Drawing Figures

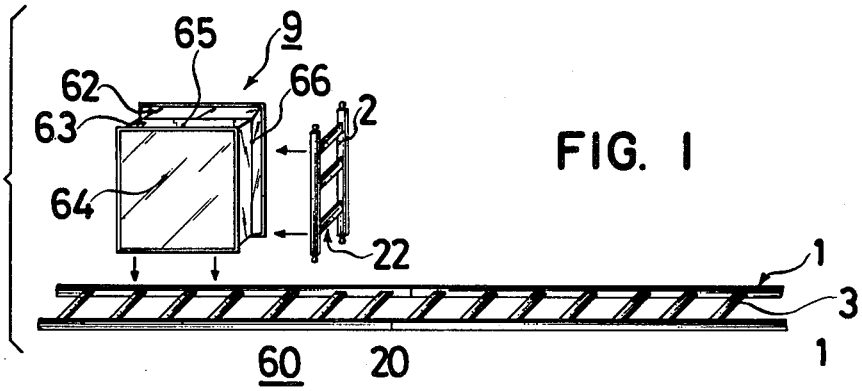
FIG. 1
FIG. 2
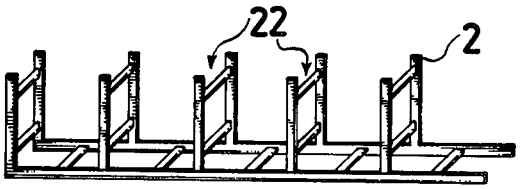
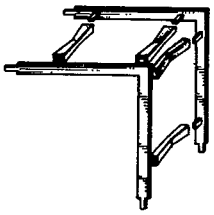
FIG. 3a
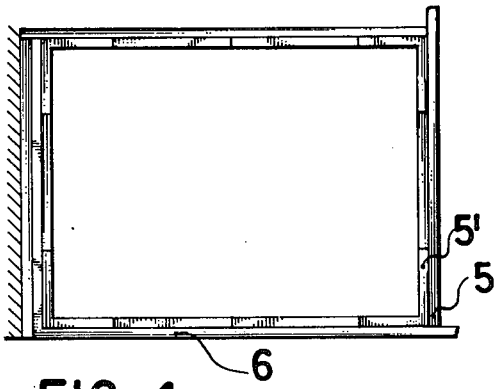
FIG. 4a
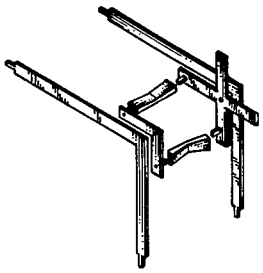
FIG. 3b
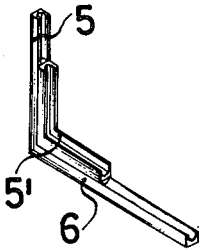
FIG. 4b
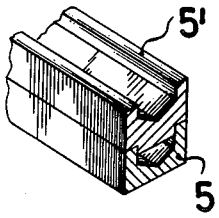
FIG. 4c

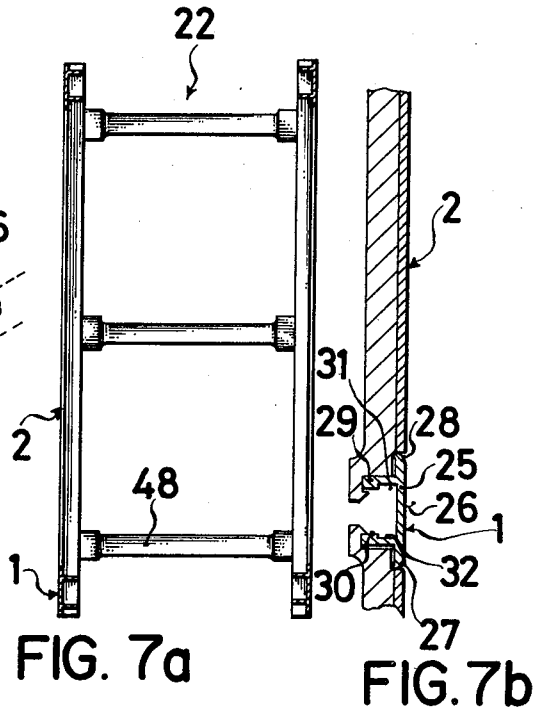
FIG. 7b
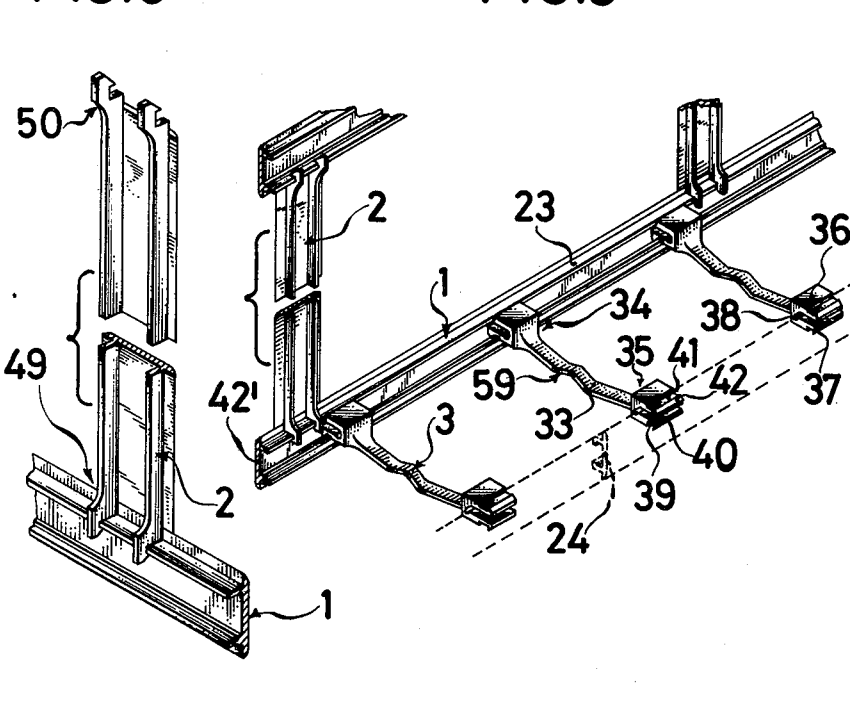
FIG. 7a
FIG.5
FIG.6

6'
6''
3
8
7
9
9'

FIG.12
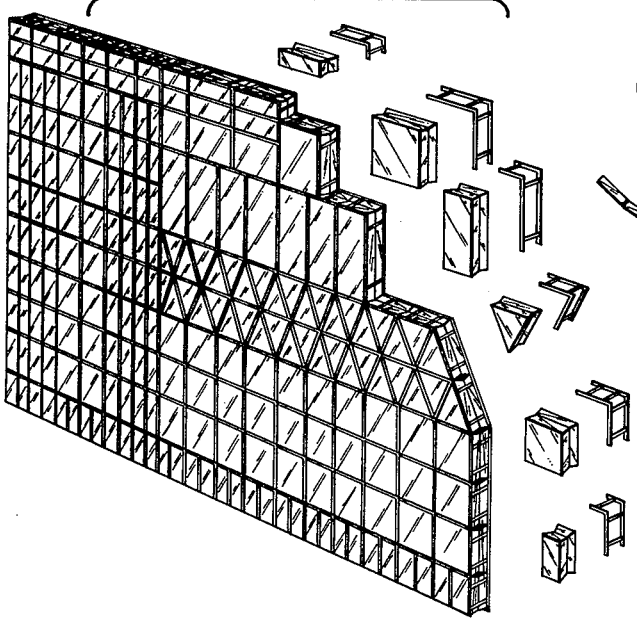
FIG.14
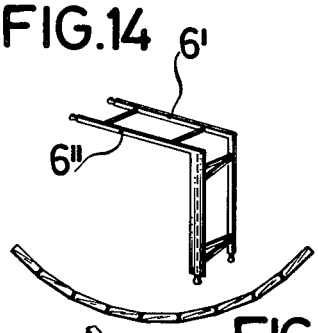
FIG.13b
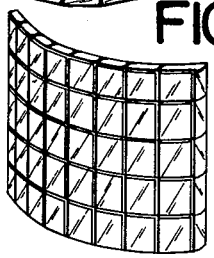
FIG.13a

PROCESS AND APPARATUS FOR ERECTING WALLS MADE OF GLASS STRUCTURAL BRICKS AND AT LEAST A JOINT MORTAR, TOGETHER WITH A JOINT LINING AND, IF NECESSARY, REINFORCEMENT

This invention is mainly concerned with a method for erecting walls made of glass structural bricks and at least one joint-mortar, together with a joint-lining and, if necessary, reinforcement. The invention is also concerned with an apparatus for the execution of this method.

As compared with brickwork of other designs, glass bricks make it possible to erect walls having more advantageous physico-structural proporties, such walls having improved insulation, for example, and allowing a considerable amount of light to pass; furthermore, the decorative aspect of glass brick makes it possible to produce novel architectural effects. Most glass bricks are hollow and, for production reasons, are made in two halves, each consisting of a structural unit with a plate forming a surrounding edge and plate-edges projecting beyond the edge, and being joined together, e.g., welded together, at a rib possibly projecting beyond the said edges. The plates as a rule having a square outline, but special shapes having different outlines are possible. Walls made of glass bricks of this kind are used, not only as decorative partitions in building interiors, but also as outer walls, or parts of outer walls, possibly instead of windows. In addition to the necessary stability, these walls must, therefore, also have other, mostly standardized properties, for example the required imperviousness.

The invention is based upon conventional brick-laying methods, in that walls of this kind are erected on the spot. It has hitherto been necessary to employ specially trained labour, since the laying of glass brick requires a considerable degree of ability and experience. Amoung other things, glass bricks must be laid with a mortar compatible with the particular properties of the material of which the bricks are made and with the surfaces thereof in contact with the joint-mortar. Furthermore, internal and external joints must be left which can subsequently be filled with a special mortar which makes the wall watertight, among other things. Apart from the craft-difficulties arising from this and other circumstances, for example, tolerances which are unavoidable in glass bricks, the erection of such walls requires additional expenditure, for instance on scaffolding required to carry out the jointing work. These difficulties have finally led to a decline in the use of glass bricks for walls.

It has, therefore, already been proposed to rationalize the work of laying glass bricks by introducing construction with prefabricated parts (German Pat. No. 20 34 066). If full use is to be made of the possibility of rationalizing construction with prefabricated parts, large-format wall-elements must be prefabricated in the horizontal position. To this end, use is commonly made of a flexible mat made of rubber or of a rubber-like synthetic material, the internal surface of which is provided with recesses or depressions adapted to the format and distribution of the bricks. The latter are thus fixed in their final positions before the concrete is poured into the mould. For elements of this kind to withstand transportation, they must be produced with anchors and metal frames. Because of the considerable weight involved, the laying of such elements does not increase the efficiency of glass-brick laying.

Nor was this successful with small wall-elements (German Utility Model No. 7 309 581). In this case, a few glass bricks are made up into a composite wall-element in a lost shuttering made of foamed material, at least the bottom of which must be removed at the construction site. However, small wall-elements of this kind are suitable only for special cases, e.g. vented cellar or garage-windows.

The invention is based upon the laying process for glass bricks described at the beginning hereof, whereby the walls are erected on the spot. It is the purpose of the invention to reduce the skill required of a mason to such an extent that correct laying of glass bricks may be carried out by unskilled and untrained labour, the equipment required at the construction site being also considerably reduced or altogether eliminated.

With the method according to the invention, the joint lining is prepared in such a manner that the strength thereof enables it to be used as shuttering for the joint-mortar and as a retainer for accurate positioning of the glass bricks in relation to each other. There is also the additional advantage of being able to use the joint-lining as an aethestically pleasing decoration in the finished wall. The system thus provided by the invention makes it possible to erect glass-brick walls of any desired size from square, rectangular, triangular or otherwise shaped bricks, and the said walls may be flat or curved in the vertical plane.

According to the basic concept of prefabricating the jointing of the glass-brick wall, and according to the basic concept of the invention, the first step in building the wall is to place the joint-lining in position in the shuttering. After this, a horizontal joint, and possibly the underlying vertical joint-parts, are filled with a suitable free-flowing joint-mortar, the necessary reinforcing rods having been fitted previously. It is, then, possible to place the following glass brick upon the lining of the horizontal joint, so that the said lining supports the brick and positions it correctly, i.e., it holds it to the still soft mortar. By pouring the mould-cavities of the joints, formed by the joint linings and the glass bricks, the masonary may be erected course by course.

In the case of large wall-elements in particular, it is desirable to operate course by course. This is done by first placting the horizontal joint-lining in the shuttering position, the mortar then being introduced into the shuttering. The lining of the vertical joints is connected to the joint lining already introduced and the mortar poured into the vertical joints. Thereafter another horizontal joint-lining is laid in shuttering position and the steps repeaded. If, on the other hand, it is desired to produce a series of courses simultaneously, it is desirable to introduce the joint-linings of a horizontal and a vertical member of a part joint defined by one brick, respectively, together.

Within the scope of the method according to the invention, it is possible to use regular, i.e., not absolutely waterproof joint-mortar, if the joints are sealed with joint-lining, since linings of this kind may be made of synthetic materials, more particularly thermoplastic materials exhibiting sealing properties. A synthetic material of this kind may also be dyed or metal-coated to achieve special aesthetic effects. On the other hand, it is also possible to use joint-mortars which provide the necessary waterproofing and also joint-mortars not hitherto used in conventional methods.

Details of the invention may be gathered from the following description of the apparatus provided, according to the invention, for the execution of the method described, and of the glass-brick walls produced with such apparatuses, in conjunction with the drawing attached hereto wherein:

FIG. 1 is a diagrammatical representation of an example of embodiment of the method according to the invention;

FIG. 2 is a modified example of an embodiment of the invention;

Figures 8, 9, 10A, 10B, 10C:
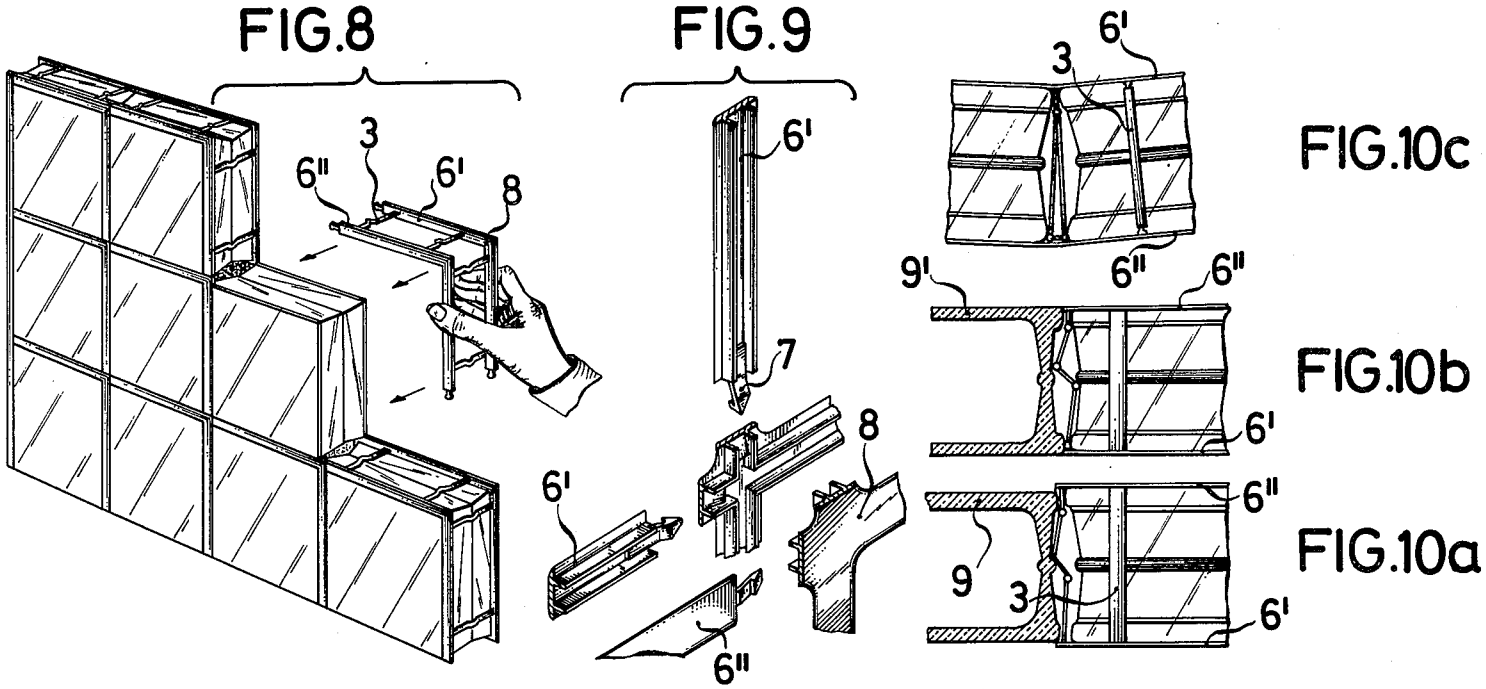
Figures 11A, 11B, 11C, 11D, 11E, 11F, 11G, 11H, 11I, 11J, 11K, 11L:
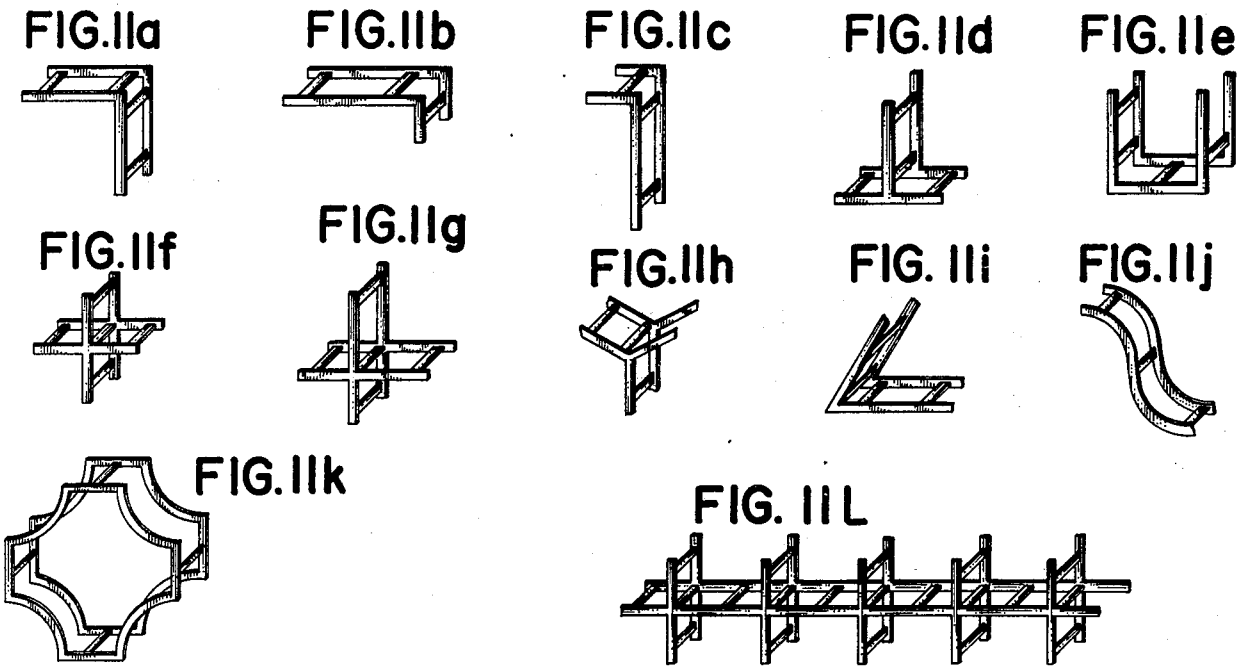
Figure 15B:
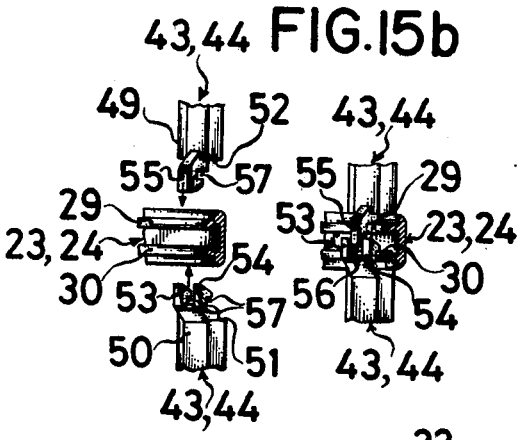
Figure 15C:
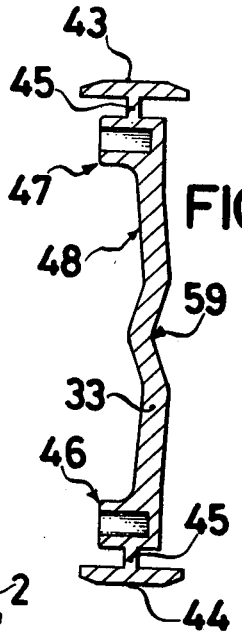
Figure 15A:
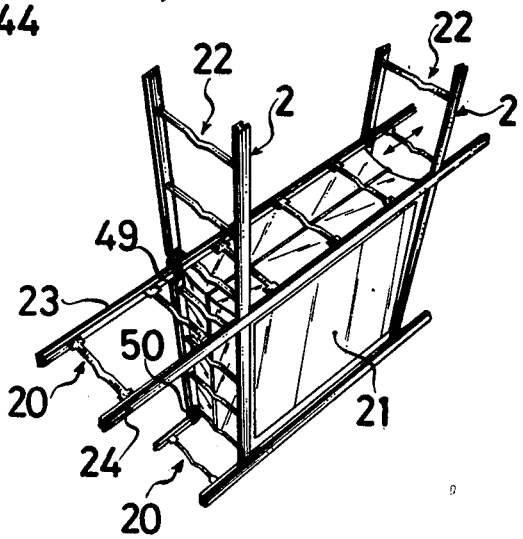
Figure 15D:
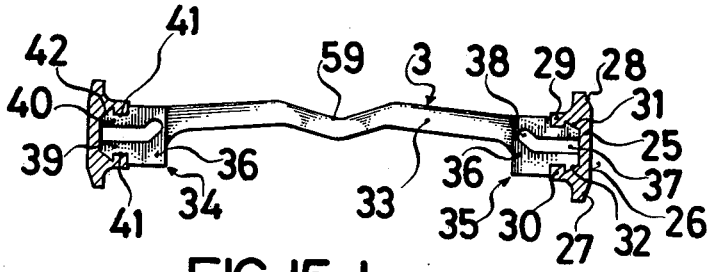

FIGS. 3*a* and 3*b* are enlarged views of angular joint-elements according to the invention;

FIGS. 4*a*, 4*b* and 4*c* show elements for framing glass structural bricks;

FIG. 5 is a perspective view of the union of the external rails of the track-like joint elements, individual parts of the joint elements having been omitted;

FIG. 6 is also a perspective view, but to an enlarged scale, of one of the joints illustrated in FIG. 5;

FIGS. 7*a* and 7*b* show a partial plan-view of a joint element, with a joint-location in section;

FIG. 8 is a diagrammatical reproduction of the method according to the invention, using angular joint-elements;

FIG. 9 shows the joint between adjacent joint-elements in perspective and broken away, according to one example of embodiment of the invention;

FIGS. 10, 10*a* 10*b* and 10*c* show a series of designs of joints in a glass-brick wall erected according to the invention in cross-section through the respective joints;

FIGS. 11*a* through FIG. 11*l* are perspective views of a series of asembled joint-elements according to the invention;

FIG. 12 is a perspective view of a glass-brick wall according to the invention and of the well-elements thereof;

FIGS. 13*a* and 13*b* show a curved glass-brick wall according to the invention in perspective and plan view;

FIG. 14 is a perspective view of a modified form of joint-element according to the invention; and FIGS. 15*a* through 15*d* are perspective views of joint elements according to the invention and according to another example of embodiment.

Before the details of the method according to the invention are described, a description will be given of the details of the prefabricated joint-elements illustrated in FIG. 15.

In this example of an embodiment of the invention, joint-elements 20 are used for the horizontal joints of a glass-brick wall, of which only one structural brick 21 is shown, while joint-elements 22 are used for the vertical joints which are in alignment with each other. The element for the horizontal joints is also visible in FIG. 5, although the elements for the vertical joints differ in that exemplary embodiment.

According to FIGS. 5 and 15, the element for the horizontal joint consists of a track 1 consisting of two parallel rails 23, 24, of similar profile, and of webs 3 constituting the ties. The rail profile is shown more accurately in FIGS. 7 and 15. It comprises an outwardly directed profiled leg 25, external surface 26 of which serves as a sighting surface for the subsequent joint in the masonry. The said leg has beveled end-edges 27, 28. Located at the same distances from the said edges of leg 25 are webs 29, 30 of substantially rectangular profile, the said webs having undercut grooves 31, 32 in their opposing surfaces. Moreover, the planes of webs 29 and 30 are parallel with each other.

This profile provides longitudinal guidance for webs 3 uniting rails 23, 24 to each other. A web of this kind has a strip-shaped central part 33 forming a structural unit with end-blocks 34, 35. The inner part of each end-block forms a bracket 36 upon or against which a glass brick may rest. Each bracket has a smooth supporting surface upon which the width tolerances of the brick are compensated for. The brackets shown are slotted from outside to inside, the said slot comprising an outer section 37 running parallel with the plane of web 33, and an adjoining inner section 38 enclosing an angle with the plane of the said web. Slot 37, 38 forms a fork, the prongs of which are marked 39, 40. The outside of each prong contains a groove 41, the outer web-projection 42 of which engages behind the undercut formed by grooves 31, 32. This allows webs 3 to hold rails 23, 24 together, but the said webs are individually displaceable along the track.

End-faces 42' of rails 23, 24 are cut off vertically and can thus be butted together jointlessly. This presents no problems since the rails are provided for the horizontal joints and may thus lie one against the other accordingly.

On the other hand, tracks 2 of the elements for vertical joints 22, which tracks co-operate with track 1, are of a length equal to the vertical length of the joint between adjacent glass bricks. The profile of tracks 2 is substantially the same as that of rails 23, 24. In the case of the rails of track 2, however, marked 43, 44 in FIG. 15, the profile differs from that shown in FIG. 7 in that profiled webs 29, 30 are replaced by a central web 45 which is integral with hollow end-blocks 46, 47 of webs 48 which otherwise correspond to parts 34, 35 of webs 3. Another difference is the connecting means provided at ends 49, 50 of track 2, which do not appear in tracks 1.

According to FIG. 15, tongues 53, 54, projecting inwardly and forwardly, and arranged in pairs, are located at end-faces 51, 52 at one end of rails 43, 44. At the other end, however, the adjacent end-faces of rails 43, 44 have only one tongue 55. The arrangement of tongue 55 in relation to tongues 53, 54 is such that it is in alignment with space 56 between tongues 53, 54. This allows webs 25 of rails 43, 44 and, therefore, the joints, to be aligned in one plane.

The outsides of the tongues contain cross-sectionally rectangular grooves 57 aligned with each other in adjacent tongues 53, 54. The width of these grooves corresponds to the width of webs 29, 30 so that the tongues may be engaged with the webs, the tongues 53, 54 at one end engaging around tongue 55 at the other end of the following rail.

In this way, according to FIG. 15, a horizontal joint-element 20 may be connected at regular intervals, determined by the format of the brick, with vertical joint-elements 22. The fact that webs 3 are displaceable allows them to be shifted away from the vertical joints in the masonry, if a continuous reinforcement is to be inserted and/or if the joint must be left free to allow the mortar to be poured in. In contrast to this, webs 48 of element 22 need not be displaced and they are, therefore, made integral with the rails (FIG. 15).

Strips 33, constituting the central portion of the webs, are of identical design in the joint-elements. They comprise a V-shaped central part 59 (FIG. 5) and thus allows the glass bricks to be positioned and reinforcements to be laid upon the part-lengths between central parts 59 and end blocks 34, 35.

As may be gathered from FIG. 1, horizontal joint-elements 29 are laid out on the flat surface—for example, the top of a wall—with their end-faces butted together to produce a continuous joint-lining 60. If necessary, the reinforcing rods mentioned in connection with V-shaped central part 59 are laid between rails 23, 24 of this lining. Joint-mortar is then added, preferably by pouring, until the space between rails 23, 24 is filled.

Joint elements 22 for the vertical joints are fitted by setting a glass brick 9 in place. The brick of this kind consists essentially of two halves 62, 63. Each of these halves has a substantially smooth plate 64, constituting a structural unit with inwardly projecting, surrounding edge 65 running substantially at right angles to the plane of the plate. The end-faces of said edges are welded together at 66. This usually leads to an outwardly projecting rib.

When the brick is set in place, profiled web 25 lines the joint over the edge of the plate, thus covering it completely on the outside. On the other hand, the edge of the plate of the brick rests upon the surfaces of blocks 34, 35 provided for the purpose. Thus, the brick cannot shift and the web constitutes an outwardly sealed shuttering for the joint-mortar.

As a rule, the procedure is to install a glass brick, then an element 22, then another glass brick, and so on until a course of bricks has been laid. This produces a joint lining as shown in FIG. 2.

The corresponding joint-element for the subsequent horizontal joint, with elements 20, is then laid upon the upper surface of this course, whereupon the joint mortar may be allowed to run into the vertical joints, until the mould-space formed by joint-elements 22 and the adjacent bricks has been completely filled. Immediately thereafter, the upper joint for the accommodation of the next course of bricks may be prepared, i.e., the joint mortar may be poured between rails 23, 24 of upper joint-element 20.

According to FIG. 2, joint-elements 20 form a structural unit with joint-elements 22. However, this defines the format of the brick, which in certain cases is possible.

FIGS. 3*a* and 3*b* illustrate angular joint elements which may be plugged into each other as shown in FIG. 9. In this case, the plug-in connection is in the form of tongues, as described in connection with FIG. 15.

FIG. 4 shows strips 5, 6 used for framing the structural bricks.

FIGS. 5, 6 and 7 relates to the example of embodiment shown in FIG. 1 and that shown in FIG. 15.

FIG. 10 is a cross section and plan view of a glass structural brick, while FIGS. 11*a* through 11*l* illustrate various exemplary embodiments of joint-elements according to the invention. FIGS. 13 and 14 show that it is possible to build curved walls. In the example of embodiment of the method according to the invention illustrated in FIG. 12, the wall elements are made up of different bricks, i.e., of glass structural bricks of different outlines.

The load-carrying capacity of the wall may be increased by fitting outer strips 5 plugged repeatedly into each other, as shown in FIG. 4. It is desirable to use angle-elements 5' to ensure perfect rectangularity of the two walls.

As an alternative, it is possible to use angle-elements 6',6'' connected to the above-mentioned webs 3. In this design according to the invention, angle-element ends 6',6'' are equipped with grooved tongues 7 engaging in matching parts provided for the purpose in edges 8 of similar angle-elements, as shown substantially in FIG. 9.

This arrangement produces the joint designs reproduced in FIGS. 10*a* to 10*c*. With bricks 9, as described in connection with FIG. 1, which represents the normal case, the section according to FIG. 10*a* is obtained. On the other hand, if the bricks shown at 9' are used, which comprise corner-recesses, this produces the type of joint shown in FIG. 10*b*.

The profiled rails may be extruded if they are fitted with displaceable webs. The webs and joint-elements are preferably injection-moulded if they form integral units.

If it is desired to build curved walls, the design according to FIG. 14 is preferred. In this case, the rails adjacent profiled leg 25 are made of different widths, corresponding to the joint-design according to FIG. 10*c*.

The various designs of joint-elements illustrated in FIG. 11 are used for specially shaped glass structural bricks.

The term glass structural bricks also includes, according to the invention, structural elements consisting partly of wood, synthetic material, ceramic, and the like.

The embodiments of the invention in which an exclusive privilege or property is claimed are defined as follows:

1. A joint element apparatus interposible between adjacent glass structural bricks in a wall, said joint element apparatus including:

at least one horizontal joint element having a pair of parallel rails spaced apart an amount determined in accordance with the thickness of the glass brick, each of said rails having an external plate-like member suitable for sealing a mortar joint between bricks, each of said rails further having a locking means including a pair of inwardly directed, spaced flanges undercut in the opposing surfaces; and said joint element having web members extending between said rails and providing open spaces therebetween, said web members having locking means on the ends thereof engaging the locking means on said rails for coupling said web members to said rails while permitting movement of said web members along said rails, said locking means of said web members comprising externally grooved forked legs suitable for engaging the locking means of said flanges, said webs having end blocks adjacent said locking means for supporting the glass structural brick when said is placed along said horizontal joint element; and said apparatus further including at least one vertical joint element appliable to the vertical surfaces of the glass structural brick, said vertical joint element comprising a pair of parallel rails spaced apart an amount determined in accordance with the thickness of the glass structural brick, each of said rails having an external plate-like member suitable for sealing a mortar joint between bricks; and a plurality of web members extending between said rails and integrally formed thereto at spaced intervals therealong, said webs having end blocks adjacent the interior of said rail abutting the glass structural brick when same is placed along said joint element, said spaced rails of said vertical member having a single tongue at one end and spaced double tongues at the other end suitable for coaction with said locking means of said horizontal joint element rails for attaching said vertical joint elements to said horizontal elements in such a manner that the single tongue at the end of one vertical joint element extending in one direction from the horizontal joint element rail is adapted to be introduced into the space between the double tongues at the other vertical joint element extending in the other direction from the horizontal joint element rail.

2. The joint element apparatus of claim 1 wherein said vertical joint element has the length of a vertical joint between adjacent glass structural bricks.

3. The joint element apparatus according to claim 1 wherein said rails have differing widths so that adjacent bricks are disposed at an angle to each other.

4. The joint element apparatus according to claim 1 wherein said joint elements have webs of different widths.

5. The joint element apparatus according to claim 1 including framing elements for the glass structural bricks.

6. A joint element apparatus interposible between adjacent glass structural bricks in a wall, said joint element apparatus including:

at least one horizontal joint element having a pair of parallel rails spaced apart an amount determined in accordance with the thickness of the glass brick, each of said rails having an external plate-like member suitable for sealing a mortar joint between bricks, each of said rails having an inwardly directed locking means; and web members extending between said rails and providing open spaces therebetween, said web members having locking means having locking means on the ends thereof engaging the locking means on said rails for coupling said web members to said rails while permitting movement of said web members along said rails, said webs having end blocks adjacent said locking means for supporting the glass structural brick when same is placed along said horizontal joint element; and said apparatus further including at least one vertical joint element appliable to the vertical surfaces of the glass structural brick, said vertical joint element comprising a pair of parallel rails spaced apart an amount determined in accordance with the thickness of the glass structural brick, each of said rails having an external plate-like member suitable for sealing a mortar joint between bricks; and a plurality of web members extending between said rails and integrally formed thereto at spaced intervals therealong, said webs having end blocks adjacent the interior of said rail abutting the glass structural brick when same is placed along said joint element, said spaced rails of said vertical member having a single tongue at one end and spaced double tongues at the other end suitable for coaction with said locking means of said horizontal joint element rails for attaching said vertical joint elements to said horizontal elements in such a manner that the single tongue at the end of one vertical joint element extending in one direction from the horizontal joint element rail is adapted to be introduced into the space between the double tongues at the other vertical joint element extending in the other direction from the horizontal joint element rail, said web members having a V-shaped central portion deflected out of the plane of said rails for permitting the insertion of a reinforcing element for a motar joint between the glass structural bricks.

7. The joint element apparatus of claim 6 wherein said vertical joint element has the length of a vertical joint between adjacent glass structural bricks.

8. The joint element apparatus according to claim 6 wherein said rails having differing widths so that adjacent bricks are disposed at an angle to each other.

9. The joint element apparatus according to claim 6 wherein said joint elements have webs of different widths.

10. The joint element apparatus according to claim 6 including framing elements for the glass structural bricks.

* * * * *